US007104173B2

(12) United States Patent
Shih

(10) Patent No.: US 7,104,173 B2
(45) Date of Patent: Sep. 12, 2006

(54) CORNER CUTTING STRUCTURE

(75) Inventor: Chao-Tung Shih, Jhonghe (TW)

(73) Assignee: Cheng Tien Int'l Corp., Taichung (TW)

( * ) Notice: Subject to any disclaimer, the term of this patent is extended or adjusted under 35 U.S.C. 154(b) by 184 days.

(21) Appl. No.: 10/660,526

(22) Filed: Sep. 12, 2003

(65) Prior Publication Data

US 2005/0056129 A1 Mar. 17, 2005

(51) Int. Cl.
*B26D 7/01* (2006.01)
*B26D 7/18* (2006.01)
*B26D 7/26* (2006.01)

(52) U.S. Cl. ..... 83/167; 83/467.1; 83/588; 83/605; 83/693; 83/694; 83/698.11; 30/229

(58) Field of Classification Search ..... 83/167, 83/467.1, 468.1, 588, 605, 606, 633, 634, 83/694, 698.11, 699.11, 268, 468.2, 468.3, 83/468.4, 468.5, 468.6, 468.7, 581, 590, 83/611, 671, 673, 692, 693, 917; 30/229
See application file for complete search history.

(56) References Cited

U.S. PATENT DOCUMENTS 629,824 A * 8/1899 Southworth ..... 83/588 X
2,082,867 A * 6/1937 Anderson ..... 83/588 X
2,163,868 A * 6/1939 Christie ..... 83/468.93
2,952,372 A * 9/1960 Foss ..... 83/167 X
3,408,889 A * 11/1968 Murphy ..... 83/599
6,016,733 A * 1/2000 Lin ..... 83/694 X
6,672,191 B1 * 1/2004 Lin ..... 83/549
6,725,756 B1 * 4/2004 Brenneke ..... 83/698.11 X
6,736,045 B1 * 5/2004 Chang ..... 83/633 X
6,752,058 B1 * 6/2004 Oh ..... 83/588 X
6,840,145 B1 * 1/2005 Lee ..... 83/167
2005/0028659 A1 * 2/2005 Lin ..... 83/167

FOREIGN PATENT DOCUMENTS

TW 85219081 8/1997

* cited by examiner

*Primary Examiner*—Clark F. Dexter

(57) ABSTRACT

An improved corner cutting structure, having a knife seat and a base pivotally connected to the knife seat. The knife seat has an inwardly recessed notch and a receiving slot formed on a periphery. The receiving slot provides the support of a blade. The base has a supporting platform and a cutting board. The cutting board and the blade of the knife seat are correspondingly installed with each other, and the supporting platform is placed underneath the notch. Thereby, when a card is disposed on the supporting platform, the knife seat is pressed rotating to move the blade downward, so as to cut the corner of the card.

9 Claims, 6 Drawing Sheets

CORNER CUTTING STRUCTURE

BACKGROUND OF THE INVENTION

The present invention relates to an improved corner cutting structure, and more particularly, to a corner cutting structure for cutting and trimming corners of a card or other paper products. The corner of the card is rounded or chamfered with various shapes by pressing the knife seat, so as to press the blade downwards to achieve the corner cutting and trimming process.

In the past, one needs to have sense of aesthetic and drawing talent for making a nice card. As most people do not possess such expertise, the motivation for making a card is low. However, as the computer information technology and the related graphic design software have been prosperously developed, the do-it-yourself (DIY) cards become more and more common. Apart from aesthetic requirement, the profile of the cards also affects the visual effect of the card. Therefore, corner cutting devices have been developed for rounding corners of cards, so as to speed up the card production.

FIG. 1 shows a conventional DIY corner cutting device disclosed in Taiwan Patent Application No. 85219081. As shown in FIG. 1, the corner cutting device includes a bulk body 10*a*, a primary knife member 11*a* and a secondary knife member 12*a*. The primary knife member 11*a* is pivotally installed to two side surfaces of the bulk body 10*a*, and the secondary knife member 12*a* is fixed to a top surface of the bulk body 10*a*. The primary and secondary knife members 11*a* and 12*a* each has a corresponding round cutting edge to suppress the side surface of the bulk body 10*a*. Therefore, the cutting edges of the primary and secondary knife bodies 11*a* and 12*a* are staggered with each other. By inserting a card to be cut at the corner of the bulk body 10*a*, the corner cutting process can be performed.

The above corner cutting device, though provides the corner cutting function, has the following drawbacks.

Firstly, the blades of the primary and secondary knife members 11*a* and 12*a* are staggered with each other, such that the thickness of the card is seriously restricted.

Secondly, the structure of the corner cutting device is so complicated that it is very laborious and costly for assembly and maintenance.

Thirdly, the primary and secondary knife members 11*a* and 12*a* are integrally formed, such that the round corner cut thereby has the constant shape.

BRIEF SUMMARY OF THE INVENTION

The present invention provides an improved corner cutting structure, in which the knife seat is pressed to rotate along a constant rotation axis to press the blade thereof moving downwardly along an arc, such that the corner of a card can be rounded or chamfered with various configurations. In addition, the card with a larger thickness can also be cut by the cutting structure.

The present invention also provides an improved corner cutting structure with a simpler structure, such that the cost and labor for assembly and maintenance are greatly reduced.

The improved corner cutting structure provided by the present invention comprises a knife seat and a base pivotally connected with the knife seat. The knife seat includes a notch and a receiving slot along a periphery of the notch. The receiving slot is used to mount a blade thereto. The base comprises a supporting platform and a cutting board. The cutting board and the blade of the knife seat are correspondingly positioned. The supporting platform is placed underneath the notch.

BRIEF DESCRIPTION OF THE DRAWINGS

These, as well as other features of the present invention, will become apparent upon reference to the drawings wherein.

DETAILED DESCRIPTION OF THE INVENTION

Figure 1:
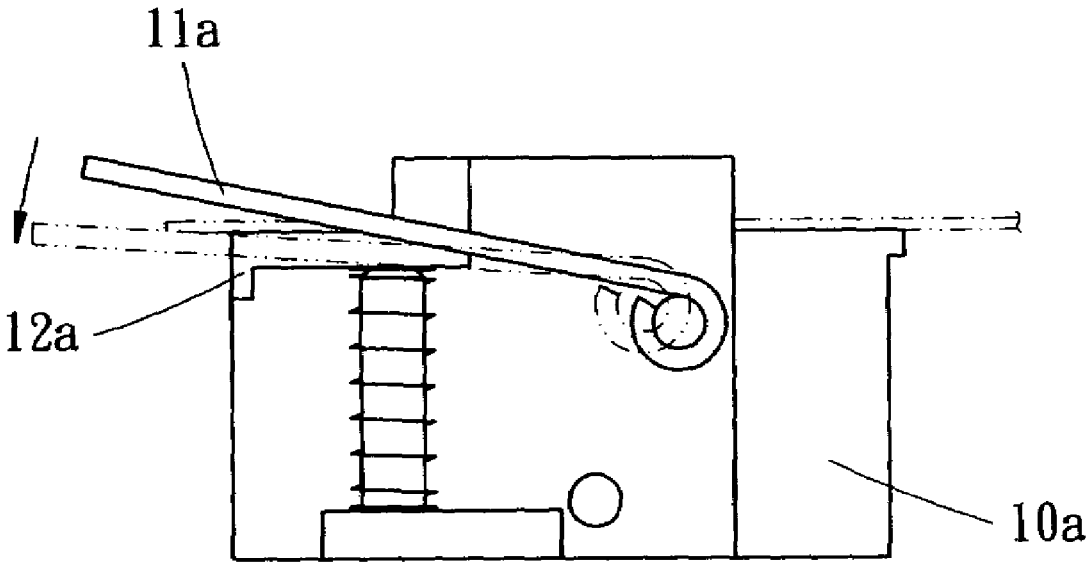
FIG. 1 PRIOR ART
FIG. 1 shows a conventional corner cutting device.
Figure 2:
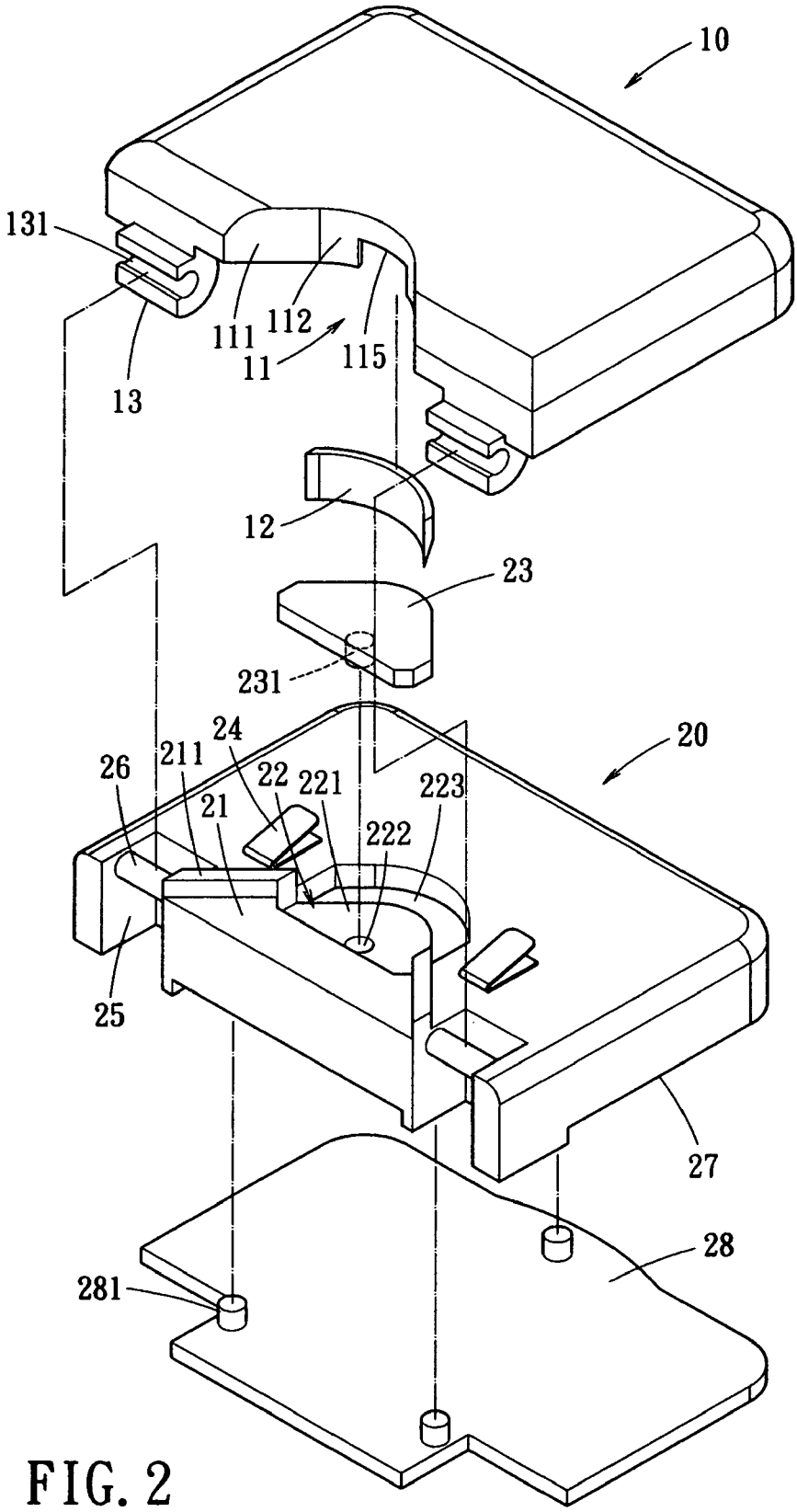
FIG. 2 shows an exploded view of a corner cutting device provided by the present invention.
Figure 3:
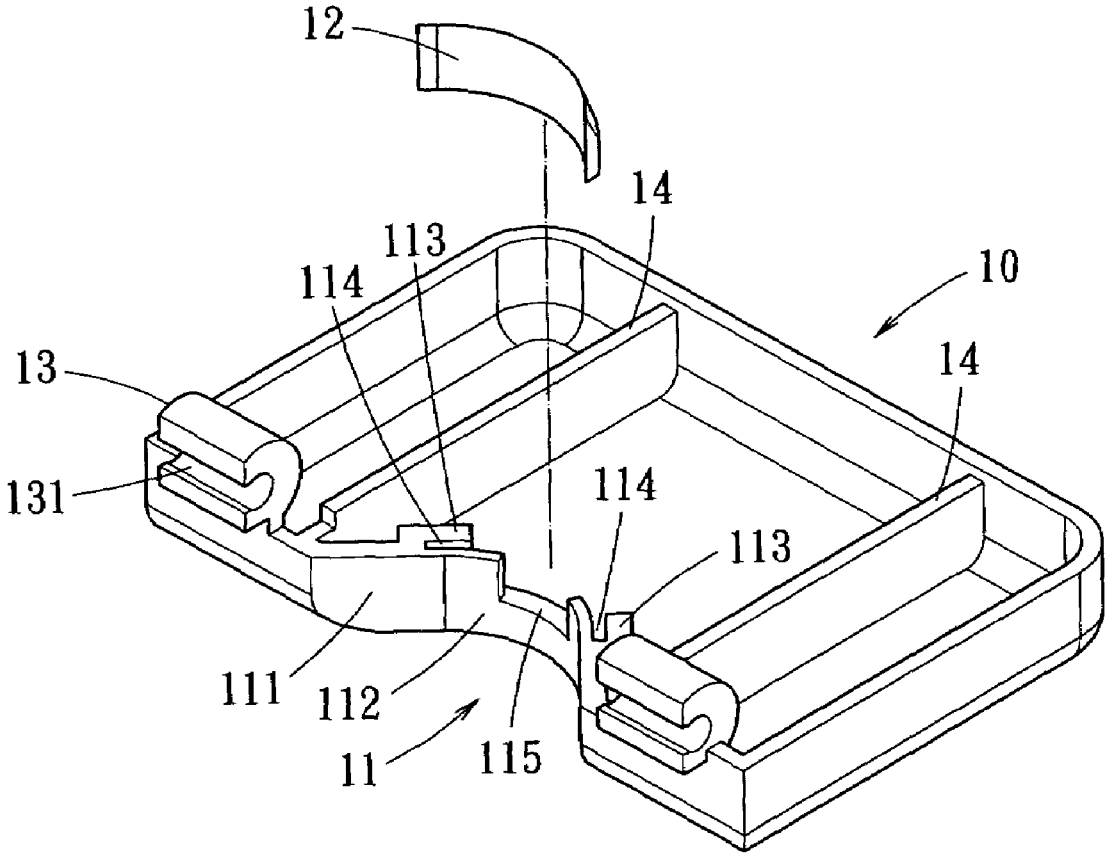
FIG. 3 shows an internal structure of the corner cutting device.
Figure 4:
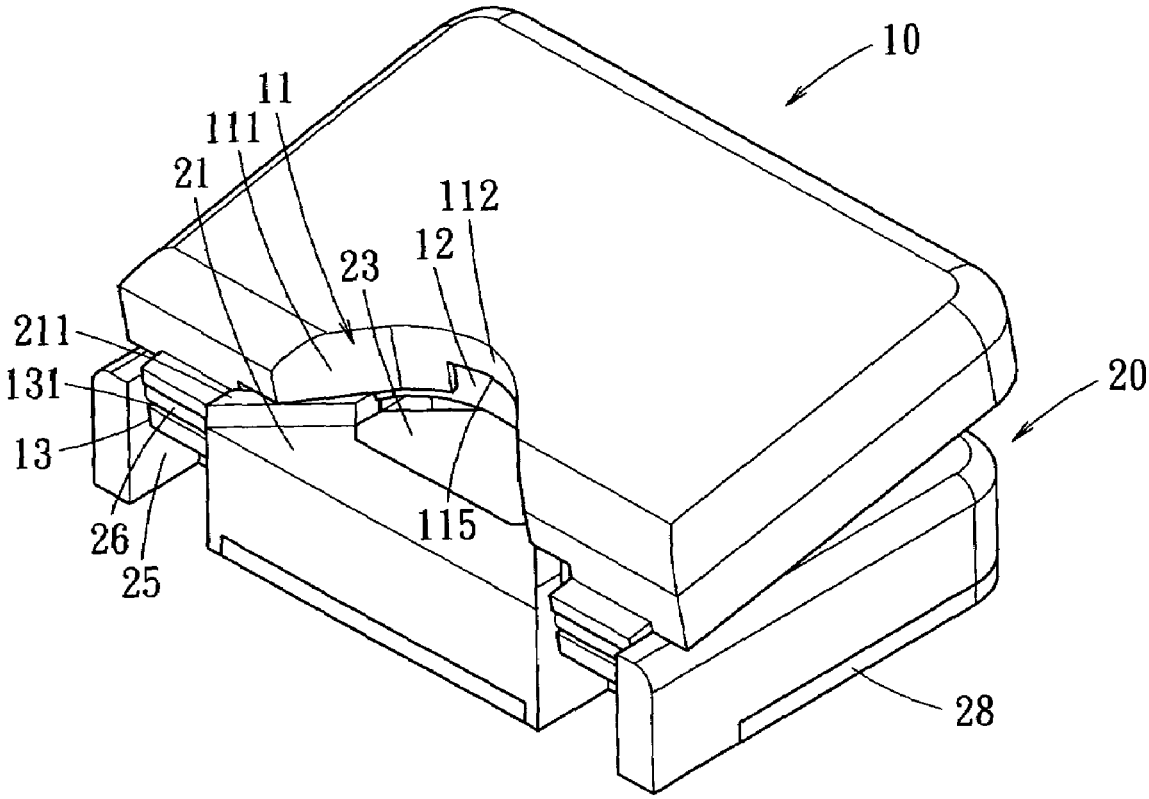
FIG. 4 shows the assembly of the corner cutting device.

Referring to FIGS. 2, 3 and 4, an exploded view, a schematic interior and an assembly of an improved corner cutting structure are illustrated. As shown, the corner cutting structure includes a knife seat 10 and a base 20.

Figure 8:
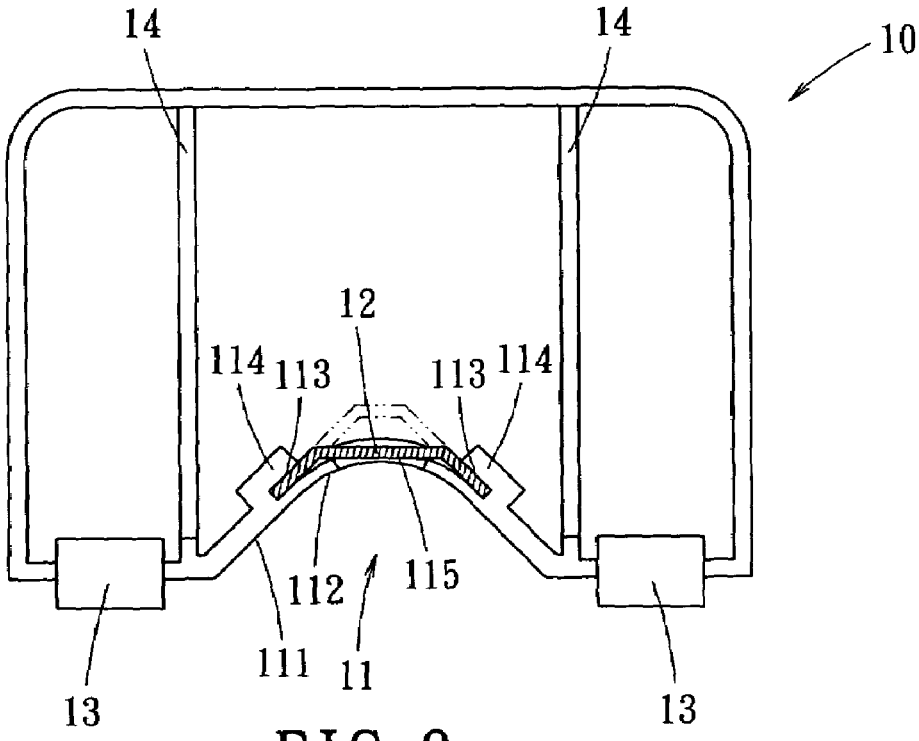
FIG. 8 shows a top view of another embodiment of the knife seat.

The knife seat 10 includes an integrally formed parallelepiped with a notch 11 recessed from a front end thereof. The notch 11 includes two inclined surfaces 111 and a curved surface 112 interconnecting these two inclined surfaces 111. Extending from the inclined surfaces 111, pressing plates 113 (as shown in FIG. 3) are formed to construct receiving slots 114 between the pressing plates 113 and the inclined surfaces 111. The receiving slot 114 allows a blade 12 to be inserted and fixed therein. The blade 12 is perpendicular to the bottom surface of the knife seat 10. The blade 12 can be an arc or trapezium configuration (as shown in FIG. 8). An opening 115 is formed at the middle of the curved surface 112. Two lugs 13 are formed on the knife seat 10 at two sides of the notch 11. Semi-circular or circular pivoting holes 131 may be formed through the lugs 13, and two longitudinal ribs 14 are formed connecting the front surface and a rear surface of the knife seat 10.

The base 20 is a hollow parallelepiped. The top surface of the base 20 includes a supporting platform 21 corresponding to the notch 11 of the knife seat 10. Two protruding block edges 211 are formed at two sides of the supporting platform 21. The block edges 211 are located right under the inclined surfaces 111 of the notch 11. The top surface 20 and an inner corner of the supporting platform 21 construct a concave recessed part 22, which includes a triangle-like flat panel 221, a through hole 222 and a curved through slot 223. The recessed part 22 allows a cutting board 23 to be placed thereon. The cutting board 23 is made of a soft material with a profile slightly smaller than the recessed part 22. Extending from the bottom surface of the cutting board 23 includes a column 231 with an exterior diameter slightly smaller than the diameter of the through hole 222. The thickness of the cutting board 23 is the same as the depth of the recessed part 22. When the cutting board 23 is placed on the flat panel 221, the column 231 is inserted through the through hole 222 to fix the cutting board 23.

Two resilient members 24 are mounted to the top surface of the base 20 near two sides of the recessed part 22. The resilient members 24 include plate springs or spiral springs. The resilient members 24 are formed over the ribs 14 of the knife seat 10. The resilient members 24 can also be mounted on the ribs 14 of the knife seat 10, such that the knife seat 10 can be released after being pressed. By the resilience of the resilient members 24, the knife seat 10 is kept with an upwardly inclined status.

A n-shaped slot 25 is formed on each side of the supporting platform 21 of the base 20. A fixing shaft 26 is fixed in each slot 25 for pivotally connecting the pivoting hole 131 of the knife seat 10. The bottom of the base 20 further comprises an opening end 27 for placing a bottom lid 28. A plurality of protruding columns 29 is formed inside of the base 20. Blind holes 291 are formed through the columns 29, while protruding cams 281 are formed on the top surface of the bottom lid 28 corresponding to the protruding columns 29. Thereby, the protruding cams 281 can be capped within the blind holes 291 of the protruding columns 29, such that a collecting chamber 30 is formed within the base 20.

Figure 5:
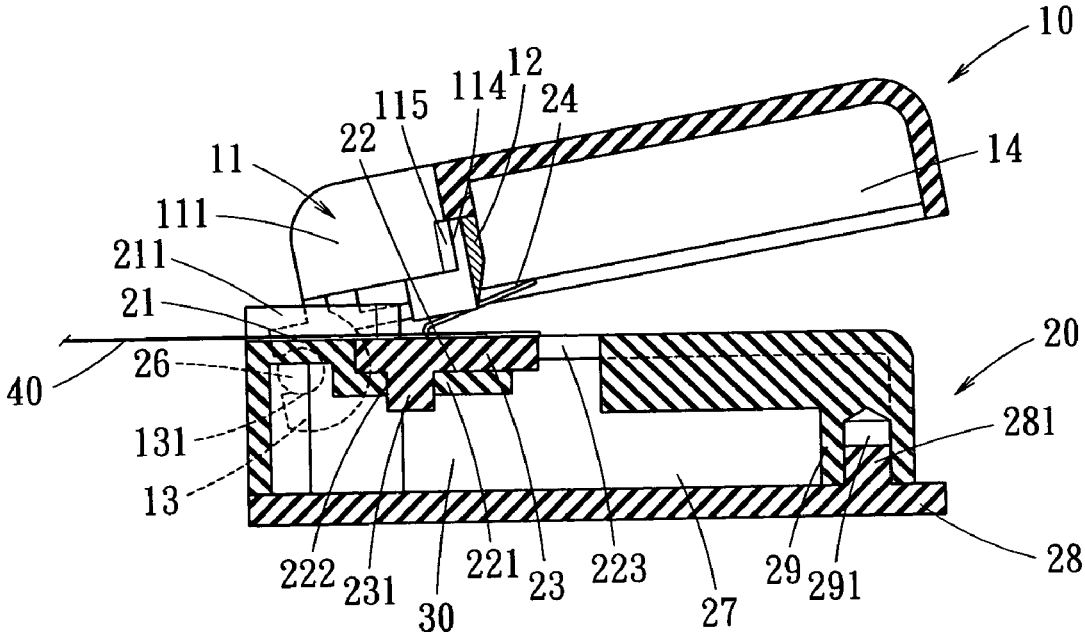
FIG. 5 shows the operation status of the corner cutting device.
Figure 6:
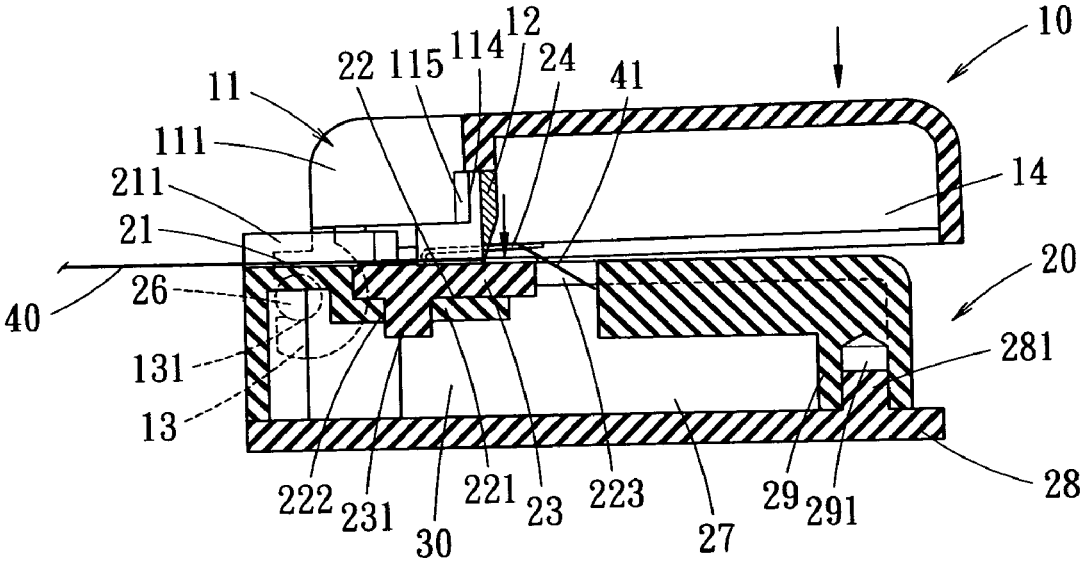
FIG. 6 shows another operation status of the corner cutting device.

Referring to FIGS. 5 and 6, two operation statuses are shown. By the above assembly, a card 40 is placed on the supporting platform 21. The block edges 211 at two sides of the platform 21 are used to block two edges of the card 40, so as to align the card 40. The knife seat 10 is pressed to drive the knife seat 10 rotating about the fixing shaft 26. The blade 12 thus moves downwardly along an arc. The cutting edge of the blade 26 touches the top surface of the card 40 to perform a cutting process. When the blade 12 is in contact with the cutting board 23, the corner cutting process is complete. The card 40 is separated from the corner 41 cut by the blade 12. The corner 41 is collected by the collecting chamber 30 through the slot 223. When the collecting chamber 30 collects a certain amount of corners, the bottom lid 28 is open for dumping the corners.

Figure 7:
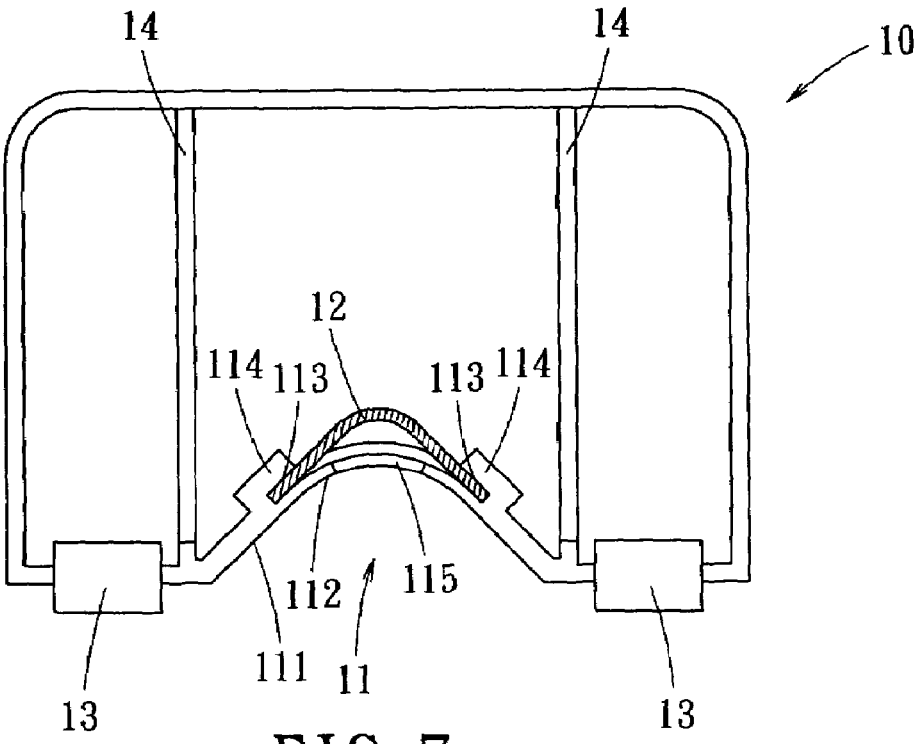
FIG. 7 shows a top view of an embodiment of the knife seat.

Referring to FIGS. 7 and 8, top views of another embodiment and the knife seat are shown. When it is required to cut the card 40 with a different corner configuration, such as cutting a chamfered corner a shown in FIG. 8, the blade 12 is removed, and a blade with another configuration is inserted.

Accordingly, the corner cutting device provided by the present invention provides at least the following advantages.

1. By the design of the blade receiving slot of the knife seat, the corner of a card can be cut with various shapes and sizes.

2. The longitudinal width of the knife seat is enlarged, such that a longer arm is obtained for pressing the knife seat. Therefore, the work for corner cutting is increased without applying additional force.

3. As a single blade is adapted, less force is required for cutting; and consequently, thicker cards or more cards can be cut at once.

This disclosure provides exemplary embodiments of a corner cutting structure. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed is:

1. A corner cutting structure, comprising:

a knife seat, including a blade vertically installed thereon; and a base pivotally connected with the knife seat, the base including a cutting board located in correspondence with the blade;

wherein when a card is placed on the base, the knife seat is pressed rotating to drive the blade downwardly towards the card, and wherein the knife seat further comprises a notch which includes two inclined surfaces and a curved surface interconnecting the inclined surfaces, a pressing plate extending from each inclined surface, and a receiving slot formed between each inclined surface and the pressing plate extending therefrom for receiving the blade.

2. The structure according to claim 1, wherein the blade is an arc-shaped or a trapezium blade.

3. The structure according to claim 1, wherein the base further comprising a supporting platform mounted to a top surface thereof, the supporting platform is located underneath the notch and has two protruding block edges under the inclined surfaces of the notch.

4. The structure according to claim 1, wherein the knife seat comprises two lugs protruding from a front surface thereof, each of the lugs includes a semi-circular pivoting slot, and the base comprises a pair of slots corresponding to the lugs, the slots of the base each comprises a fixing shaft for pivotally connecting within the corresponding pivoting slot.

5. The structure according to claim 1, wherein the knife seat comprises two lugs protruding from a front surface thereof, each of the lugs includes a pivoting slot, and the base comprises a pair of slots corresponding to the lugs, the slots of the base each comprises a fixing shaft for pivotally connecting within the corresponding pivoting slot.

6. The structure according to claim 1, wherein the knife seat comprises two ribs formed therein, and the base comprises a resilient member mounted to cooperate with each of the ribs, the resilient members each including a plate spring or a spiral spring.

7. The structure according to claim 1, wherein the base includes a recessed part formed on a top surface thereof, the recessed part comprises a flat panel, a through hole and a through slot, the recessed part allowing the cutting board placed therein, and the cutting board includes a column to be inserted into the through hole for fixing the cutting board to the base.

8. The structure according to claim 1, wherein the base includes at least one resilient member and the knife seat includes two ribs therein, the resilient member is aligned with one of the ribs and includes a plate spring or a spiral spring.

9. The structure according to claim 1, wherein the base includes an opening at a bottom surface thereof and a lid to cover the opening, the base further comprises a plurality of protruding columns, a blind hole in each protruding column, and the lid includes a plurality of protruding cams to be engaged with the blind holes to form a collecting chamber within the base.

* * * * *